US009780426B2

(12) United States Patent
Kang et al.

(10) Patent No.: US 9,780,426 B2
(45) Date of Patent: Oct. 3, 2017

(54) PHASE SHIFTER, ACCELERATOR AND METHOD OF OPERATING THE SAME

(71) Applicants: TSINGHUA UNIVERSITY, Beijing (CN); NUCTECH COMPANY LIMITED, Beijing (CN)

(72) Inventors: Kejun Kang, Beijing (CN); Jiaru Shi, Beijing (CN); Ping Wang, Beijing (CN); Chuanxiang Tang, Beijing (CN); Huaibi Chen, Beijing (CN); Yaohong Liu, Beijing (CN); Xinshui Yan, Beijing (CN); Wenhui Huang, Beijing (CN)

(73) Assignees: TSINGHUA UNIVERSITY, Beijing (CN); NUCTECH COMPANY LIMITED, Beijing (CN)

( * ) Notice: Subject to any disclaimer, the term of this patent is extended or adjusted under 35 U.S.C. 154(b) by 0 days.

(21) Appl. No.: 15/281,026

(22) Filed: Sep. 29, 2016

(65) Prior Publication Data

US 2017/0187085 A1 Jun. 29, 2017

(30) Foreign Application Priority Data

Dec. 25, 2015 (CN) ..... 2015 1 0996025

(51) Int. Cl.
*H01P 1/18* (2006.01)
*H05H 7/00* (2006.01)
(Continued)

(52) U.S. Cl.
CPC ..... *H01P 1/182* (2013.01); *H01P 5/02* (2013.01); *H05H 5/03* (2013.01); *H05H 5/06* (2013.01)

(58) Field of Classification Search
CPC .. H01P 1/182; H01P 5/02; H05H 5/03; H05H 5/06
(Continued)

(56) References Cited

U.S. PATENT DOCUMENTS 3,621,481 A * 11/1971 Perreault ..... H01P 1/182 333/113

OTHER PUBLICATIONS

Moon-Hee Chung et al. "Development of a 85-115 GHZ 90-deg Phase Shifter using Corrugated Square Waveguide", Oct. 6-9, 2014, Proceedings of the 44th European Microwave Conference, pp. 1146-1149.*

* cited by examiner

*Primary Examiner* — Daniel D Chang
(74) *Attorney, Agent, or Firm* — Kilpatrick Townsend & Stockton LLP

(57) ABSTRACT

The present disclosure relates to a phase shifter, an accelerator, and an operating method therefor. The phase shifter comprises a rotating part having a first hollow structure, the first hollow structure having a first cavity, a distance between a circumference of the cross section of the first cavity and a rotation center of the rotating part changing periodically and continuously in a peripheral direction, such that when the rotatory part rotates, a phase shift occurs between two adjacent microwave pulses at an outlet of the phase shifter. The operating method comprises transmitting a microwave pulse within the accelerator at a repetitive frequency v Hertz; the driving devices drives the rotating part to rotate at a rotation speed of n RPM, wherein n=15v*m, m is an odd number, 1, 3, 5 . . . , such that when transmitting a microwave pulse each time, the long axis of the oval cross section of the first cavity of the rotatory part is rotated to a horizontal or vertical state.

12 Claims, 3 Drawing Sheets

(51) Int. Cl.
*H01P 5/02* (2006.01)
*H05H 5/03* (2006.01)
*H05H 5/06* (2006.01)

(58) Field of Classification Search
USPC ..... 315/506
See application file for complete search history.

PHASE SHIFTER, ACCELERATOR AND METHOD OF OPERATING THE SAME

CROSS-REFERENCE TO RELATED APPLICATION

The present disclosure claims priority to the Chinese National Application No. 201510996025.6, flied on Dec. 25, 2015, the entire disclosure of which application is expressly incorporated herein by reference.

FIELD OF THE DISCLOSURE

The present disclosure relates to microwave and accelerator, and more specifically relates to a phase shifter, an accelerator, and methods of operating the same.

BACKGROUND OF THE DISCLOSURE

A phase shifter, as one of very important microwave devices in microwave applications, has very wide applications in fields of radar, accelerators, communications, and instruments and meters. Generally, by inserting medium sheets, pins, and ferrites in the structure, change of waveguide coefficients may be achieved, and then an phase of the microwave may be changed.

The phase shifter has unique applications in synthesis and distribution of high-power microwave because it can change microwave phases. The faster the phase shift speed is, the higher the repetition frequency of system working may become. High-power phase shifters have already been studied. They place a ferrite or ferroelectrics of a certain geometric size in the waveguide, so as to change phase shift by changing material parameters of the ferrite or ferroelectrics using a peripheral high-voltage external circuit. Design of such phase shifters is highly demanding on the external circuit. To enable a fast phase shift, the external pulse voltage is generally required to be thousands of voltages; meanwhile, it is also highly demanding on a rising edge of the pulse. Besides, in order to provide a good transmission characteristic to the microwave, some other mediums are usually added in the structure of these phase shifters. Therefore, the design is relatively complex.

A common phase shifter is a dual-port microwave element, where the microwave enters from one port and outlets from the other port. Change of phase is achieved by adding a membrane sheet, ferrite and the like in a transmission segment. However, such prior art phase shifters that change ferrite material parameters through an external circuit have the following defects:

(1) limited phase shift. The design provided in current literatures can achieve a fast change of the phase in a very short time, but the change range of the phase is very small, which cannot achieve a 180° phase change.

(2) poor stability. The current phase shifter employs a method of external circuit control and achieves change of microwave phase by changing electric parameters or magnetic parameters of the material, which is highly demanding on the stability of external circuit voltage. The current design mostly captures a segment with a relatively good effect in a measurement result as the design result;

(3) material limit. The currently existing phase shifter has a ferrite material or other material within the phase shifter, which increases design difficulty;

(4) external circuit use. Through the external circuit, material parameters are changed and then phase size is changed. The voltage of the external circuit is usually thousands of voltages.

In the prior art, a single phase shifter has not achieved 180° phase shift between two adjacent microwave pulses, mainly because microwave transmission is limited. When the microwave passes through the phase shifter, the power will be lowered, and part of microwave will be reflected simultaneously; moreover, a ferrite-based phase shifter should guarantee a small reflection, a small loss, and a fast speed. All of the above are limiting factors.

SUMMARY OF THE DISCLOSURE

In order to overcome the technical defects above, a technical problem being solved by the present disclosure is to provide a phase shifter, an accelerator and a method of operating the same, to achieve a phase shift of two adjacent microwave pulses at an outlet of the phase shifter.

In order to solve the technical problem above, the present disclosure provides a phase shifter, comprising a rotating part having a first hollow structure, the first hollow structure has a first cavity, a distance between a circumference of the cross section of the first cavity and a rotation center of the rotating part changes periodically and continuously in a peripheral direction, such that when the rotatory part rotates, a phase shift occurs between two adjacent microwave pulses at an outlet of the phase shifter.

Further, the distance between a circumference of the cross section of the first cavity and a rotation center of the rotating part changes periodically and continuously in the peripheral direction at 180°.

Further, the phase shift ranges from 0°-180°.

Further, the cross section of the first cavity assumes an oval or rectangular shape.

Further, the cross section of the first cavity assumes an equilateral triangle or an equilateral polygon.

Further, the first hollow structure further comprises two first gradual transition cavities and two first circular waveguides disposed adjacent to two ends of the rotating part, two of the first circular waveguides are communicating with two ends of the first cavity through the corresponding first gradual transition cavities.

Further, there also comprises two fixing parts respectively adjacent to the microwave inlet and the microwave outlet, the rotating part being rotatable relative to the fixing part; the fixing part comprising a second hollow structure; the second hollow structure having a second cavity; the second cavity comprises a square waveguide, a second gradual transition cavity, and a second circular waveguide, the square waveguide communicating with the second circular waveguide through the second gradual transition cavity, the second circular waveguide being adjacent to the rotating part.

Further, the inner diameter of the first circular waveguide is consistent with that of the second circular waveguide.

Further, there further comprises a choking structure, the choking structure being disposed between the first circular waveguide and the second circular waveguide.

The present disclosure further provides an accelerator comprising an accelerating tube for accelerating electrons in an accelerator, a driving devices and a phase shifter of the present disclosure, the phase shifter being disposed in the accelerating tube, the driving devices being for driving rotation of the rotating part.

Further, the accelerating tube comprises a first accelerating tube and a second accelerating tube, the first accelerating tube is disposed upstream of the second accelerating tube, the phase shifter being disposed in the second accelerating tube.

Additionally, the present disclosure further provides an operating method of the accelerator, a cross section of the first cavity being in an oval shape, the operating method comprising:

transmitting a microwave pulse within the accelerator at a repetitive frequency v Hertz;

the driving devices drives the rotating part to rotate at a rotation speed of n RPM, wherein n=15v*m, m is an odd number, 1, 3, 5 . . . , such that when transmitting a microwave pulse each time, the long axis of the oval cross section of the first cavity of the rotatory part is rotated to a horizontal or vertical state, and the phase shift between two adjacent microwave pluses at an outlet of the phase shifter being 180°.

According to a concept of the present disclosure, by rotating a rotating part, the first cavity with the distance between a circumference of the cross section in the rotating part and rotatory center of the rotating part continuously changing periodically also rotate along, and the cross section orientation of the first cavity also changes, such that the two adjacent microwave pulses will meet differently oriented cross-sections; therefore, there is a phase shift between two adjacent microwave pulses of the phase shifter.

BRIEF DESCRIPTION OF DRAWINGS

The accompanying drawings as illustrated herein provide further understanding of the present disclosure, which constitute a part of the present application; the schematic embodiments of the present disclosure and their illustrations are used for explaining the present disclosure, which do not constitute improper limitation of the present disclosure. In the accompanying drawings.

DETAILED DESCRIPTION

The preferred embodiments of the present disclosure are intended to facilitate further illustration of the concept of the present disclosure, the solved technical problem, the technical feature constituting the technical solution, and the technical effect as achieved. It should be noted that illustration of these embodiments does not constitute a limitation to the present disclosure. Besides, the technical features involved in the embodiments of the present disclosure as illustrated hereinafter may be combined with each other as long as they do not constitute conflict with each other.

Expressions "first" and "second" appearing in the present disclosure are only for ease of depiction so as to distinguish different components with the same names, which do not indicate a sequential relationship or a primary-slave relationship.

In the depiction of the present disclosure, it should be understood that orientations or positional relationships indicated by the terms "center," "longitudinal," "transverse," "front," "rear," "left," "right," "vertical," "horizontal," "top," "bottom," "inner," "outer" are based on the orientations or positional relationships shown in the accompanying drawings, only for facilitating depiction of the present disclosure and simplifying the depiction, not for indicating or suggesting that the means or elements must have specific orientations, and constructed and operated with specific orientations; therefore, they cannot be understood as limitation to the protection scope of the present disclosure.

Figure 1:
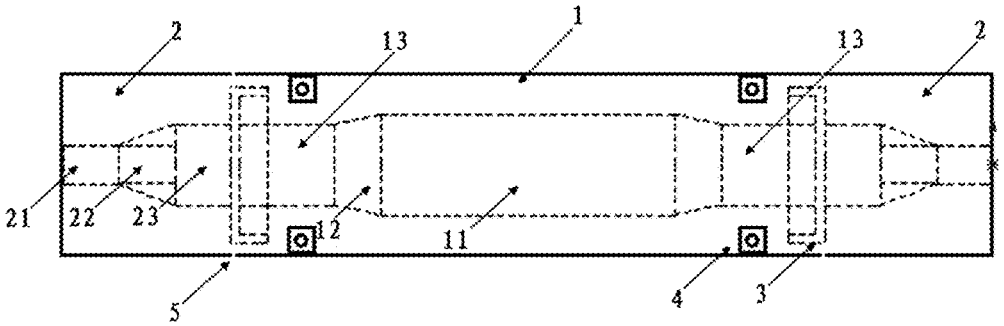
FIG. 1 illustrates a structural diagram of a phase shifter according to the present disclosure.

The present disclosure changes the prior manner of achieving microwave phase shift by changing ferrite material parameters through an external circuit and provides a phase shifter controlled in a mechanical manner. As illustrated in FIG. 1, the phase shifter comprises a rotating part 1 having a first hollow structure, a first end and a second end of the first hollow structure acting as a microwave inlet and a microwave outlet respectively, the first hollow structure having a first cavity 11, the distance between a circumference of the cross section of the first cavity and a rotation center of the rotating part changes periodically and continuously in the peripheral direction, such that when the rotatory part 1 rotates, the two adjacent microwave pulses will face cross sections of the first cavity 11 of different orientations when passing through the rotating part 1, and a phase shift will occur between the two adjacent microwave pulses.

Specifically, by rotating the rotating part 1, the first cavity 11 also rotates along; in this way, the orientation of the cross section of the first cavity 11 may be changed continuously, such that when passing through the first cavity, the microwave will meet its different orientation. Regarding how to implement rotation of the rotating part 1, in a specific implementation structure as shown in FIG. 1, the phase shifter also comprises a bearing 4 that bears the rotating part 1 to rotate. Power of rotation may be provided by a co-axial motor, or a rotor of the motor may be directly disposed on the rotating part 1. By controlling a rotation speed of the motor, fast phase shifting is enabled; the time of phase shifting may be implemented by controlling rotation speed of the motor.

By designing the distance between a circumference of the cross section of the cavity 11 and the rotation center of the rotating part 1 to change periodically and continuously, the phase shifter according to the embodiment of the present disclosure enables periodical change of the cross-sectional orientation of the first cavity 11 through rotation of the first cavity 11 after the microwave enters into the first cavity 11 from the microwave inlet, thereby controlling phase change of the two adjacent microwave pulses. The distance between a circumference of the cross section of the first cavity 11 and the rotation center of the rotating part 1 changes periodically and continuously in the periphery.

Figure 2:
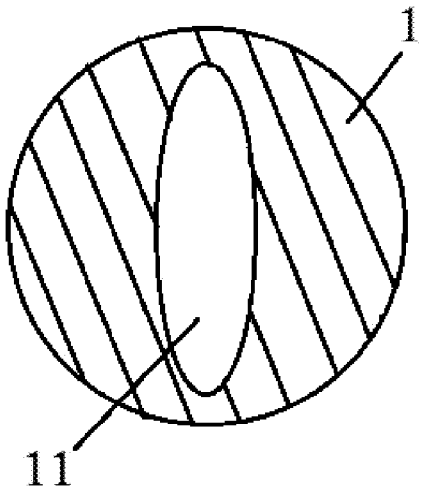
FIG. 2 illustrates a cavity diagram of a cavity of a rotating part in a phase shifter according to an embodiment of the present disclosure.
Figure 3:
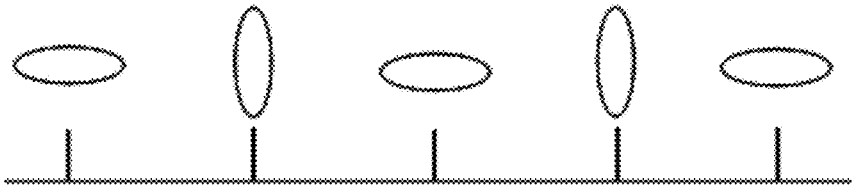
FIG. 3 illustrates a position diagram of a rotary cavity in the phase shifter at different time according to the present disclosure.
Figure 4:
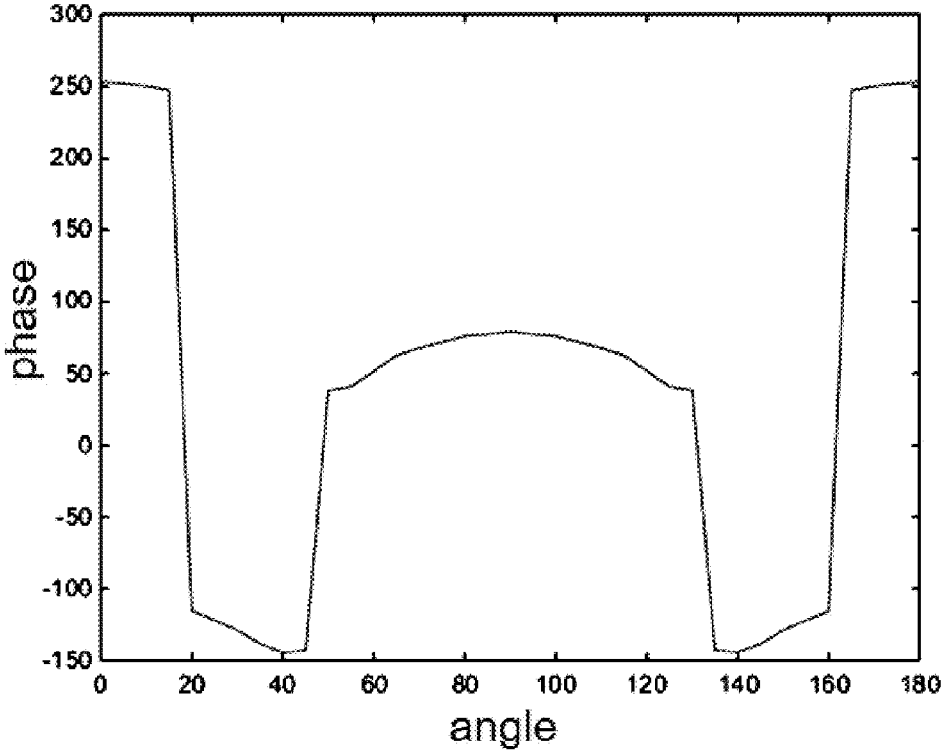
FIG. 4 illustrates a curve schematic diagram of a microwave phase changing with rotatory angle of the rotating part in a working procedure of the phase shifter.

Optionally, a contour of the cross-section of the first cavity 11 is rectangular or oval as illustrated in FIG. 2. The distance between a circumference of the cross section of the first cavity 11 and the rotation center of the rotating part 1 changes continuously with a period of 180°. As illustrated in FIG. 3, the first cavity 11 causes the two adjacent microwave pulses to have a 180° phase shift at an outlet of the phase shifter at respective positions rotating with an interval of 90° and the two adjacent microwaves pluses are incident at two adjacent positions wherein the cross section of the first lumen 11 is located, respectively. For example, the repetition frequency of the microwave pulse is 1000 Hz, and the two adjacent microwave pulses have an interval of 1 ms; therefore, the phase shift between two adjacent microwave pulses at the outlet of the phase shifter is 180°. For example, if the phase of one of two adjacent microwave pulses is 0°, then the other one is 180°, and the phase shift therebetween is 180°; vice versa, changing periodically as illustrated in FIG. 4.

Of course, the phase shift may also be other values within the range of 0°-180°, which is associated with the cross-section shape of the first cavity 11. The cross-section shape of the first cavity 11 may be equilateral triangle or equilateral polygon so as to guarantee that its cross-section shape is symmetrical relative to the rotation center.

As an improvement to the embodiment, as illustrated in FIG. 1, the first hollow structure further comprises a first gradual transition cavity 12 and two first circular waveguide 13 disposed respectively at the first end and the second end; the corresponding first circular waveguide 13 communicates with the first end and the second end of the first cavity 11 via the first gradual transition cavity 12, respectively. The first circular waveguide 13 is provided to be capable of reducing reflection of the incident microwave, while setting of the first gradual transition cavity 12 mainly considers smooth transition between the first circular waveguide 13 and the first cavity 11 in structure, such that the circular wave gradually changes and enters the first cavity 11, while such smooth transmission structure is easily processed. In addition, the first circular waveguide 13 and the first gradual transmission cavity 12 may also employ other shapes, such that they, as a whole, act as a guide structure to achieve gradual transition of the structure to guide the incident waveguide within the first cavity 11.

As a further improvement to the embodiment, as illustrated in FIG. 1, the phase shifter also comprises fixing parts 2 symmetrically disposed adjacent to the microwave inlet and the microwave outlet. The rotating part 1 can rotate relative to the fixing part 2. The fixing part 2 has a second hollow structure, the second hollow structure having a second cavity. The second cavity comprises a square waveguide 21, a second gradual transition cavity 22, and a second circular waveguide 23. The square waveguide 21 communicates with the second circular waveguide 23 through the second gradual transition cavity 22. The second circular waveguide 23 is adjacent to the rotary part 1, thereby achieving that the fixing part 2 gradually changes the square waveguide 3 into circular waveguide 5. It should be noted that the square waveguide refers to a cavity structure having a cross section in a square shape. Correspondingly, the circular waveguide refers to a cavity structure with a cross section in a circular shape. Because the microwave entering into the fixing part 2 is mainly a square wave, disposing of the square waveguide 3 can also reduce microwave reflection, while design of the first gradual transition cavity 4 mainly considers structural smooth transition between the square waveguide 3 and the circular waveguide 5, such that the square wave gradually changes into the circular wave to enter the first cavity 11 for phase shifting; moreover, such smooth transmission structure is easily processed. In addition, the square waveguide 21 and the second gradual transition cavity 22 may also employ other shapes. However, the structure of the current phase shifters is mainly square waveguide. In practical applications, it is not limited to the square waveguide 21, and the circular waveguide may also be used. The square waveguide 21 and the second gradual transition cavity 22 as a whole may act as a pre-processing structure, mainly for guiding the microwave to change into the circular wave from the second hollow structure of the fixing part 2 into the first hollow structure. Preferably, an inner diameter of the first circular waveguide 13 is consistent with that of the second circular waveguide 23, thereby guaranteeing consistency of the circular wave after entering the first hollow structure.

The phase shifter of the present disclosure may also comprise a choking structure 3, the choking structure 3 being provided between the first circular waveguide 13 and the second circular waveguide 23 so as to prevent loss at a gap 5 therebetween. The choking structure 3 may be disposed between the first circular waveguide 13 and the second circular waveguide 23 without affecting rotation of the rotating part 1 relative to the fixing part 2. It actually shifts the short-circuit face. The short-circuit face is a metal face, and the microwave is fully reflected on the short-circuit face.

Therefore, the working principle of the phase shifter will be specifically provided with an example that the cross section of the first cavity 11 is oval, i.e., the first cavity 11 is an oval waveguide, with reference to the accompanying drawings:

As illustrated in FIG. 1, the microwave enters the second hollow structure of the first end (left end) and then sequentially enters the second circular waveguide 23 from the square waveguide 21 and the second gradual transition cavity 22; and the square wave is changed into the circular wave; the circular wave enters the first circular waveguide 13 of the first end (left end), and then enters the oval waveguide after entering the first gradual transition cavity 12 of the first end; the circular wave gradually changes into the oval wave; by controlling rotation of the rotating part 2, the microwave will face different transverse cross section when passing through the first cavity 11, such that microwave pulses at different times meet different cross sections by mechanical control so as to achieve intermittent phase shift of the microwave; the phase shifted microwave enters the first circular waveguide 13 of the second end through the first gradual transition cavity 12 of the second end (right end), and the oval wave then gradually changes into the circular wave; the circular wave, after entering the second circular waveguide 22 of the second end from the microwave outlet, enters the square waveguide 21 of the second end (right end) through a second gradual transition cavity 22 at the corresponding position, and the circular wave then gradually changes into the square wave. Fast change of the microwave phase may be achieved by controlling the rotation speed of the rotating part 1 through the driving devices.

In the embodiment of the phase shifter of the present disclosure, parameter designs of respective components are mainly considered from the following perspectives. Selection of the circular waveguide diameter is associated with frequency of the microwave, while selection of the length is mainly associated with phase shift. The larger the phase shift is, the longer the length is. Except the oval waveguide, other parts will not change the phase shift, and it is just the rotation of the oval waveguide to change internal boundary conditions. The geometric parameters long axis a and short axis b of the oval are main parameters for phase shift change; the larger the difference between the long axis a and the short axis b is, the larger the phase shift of the same distance is.

It is seen from the aforesaid analysis that this kind of phase shifter may change the time taken for achieving the same phase shift amount by adjusting a relative rotary speed of the rotating part 1 and the fixing part 2, the length difference between the long axis a and the short axis b of the oval, and the overall length of the phase shifter; the faster the relative rotary speed of the rotating part 1 and the fixing part 2 is, the shorter the time taken for the microwave to generate the same phase shift.

Figure 5:
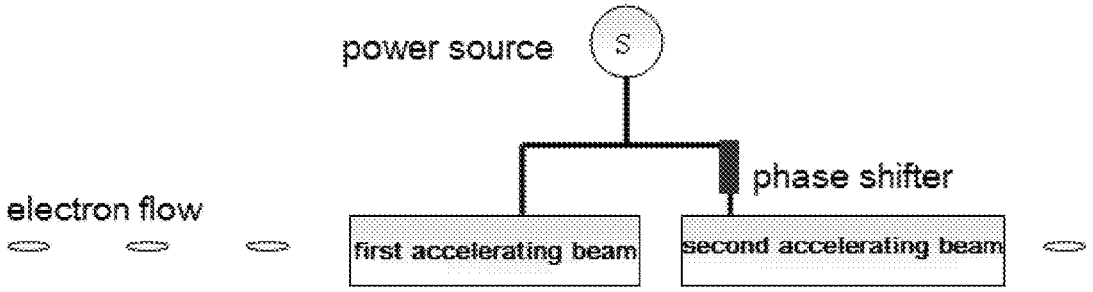
FIG. 5 illustrates a structural schematic diagram of an accelerator including a phase shifter according to the present disclosure.

Besides, the present disclosure further provides an accelerator that has a phase shifter as aforesaid and a driving devices, the driving devices is for driving a rotator (e.g., a motor) in the phase shifter to rotate. As illustrated in FIG. 5, a dual-energy accelerator comprises two segments of accelerating tubes. The first segment of accelerating tube accelerates the electronics, while the microwave phase of the second segment of accelerating tube is controlled by the phase shifter of the present disclosure. The electron beam is accelerated by the first segment of accelerating tube and then passes through the second segment of accelerating tube. This will generate two kinds of electron beams of different energies.

For example, the repetition frequency of microwave pulse is 50 Hz, i.e., emitting 50 microwave pulses per second; when the first microwave pulse enters an accelerator, the phase shifter is in the first phase; at this point, the electrons accelerated out is an energy. When an adjacent second microwave pulse enters the accelerator, because the phase shifter is in the second phase, the phase of the second microwave changes, such that the electrons accelerated out is another energy. Within one second, a plurality of electron beams of different energies will be accelerated out.

A basic procedure of implementing a dual-energy accelerator based on a phase shifter has been discussed above. The phase shifter here may be ferrite type or mechanical rotary type.

Hereinafter, an operating method of the accelerator according to the present disclosure will be discussed. The relationship between the rotation speed of the motor and the repetition frequency of the microwave pulse is provided below. FIG. 3 illustrates a position diagram of a rotary cavity in the phase shifter at different time according to the present disclosure. Suppose the phase corresponding to a horizontal oval waveguide of the long axis is 0°, and the phase corresponding to a vertical oval waveguide of the long axis is 180°; suppose the rotating speed of the motor is n rotations/minute, the time taken for each turn is 60/n seconds. Suppose the repetition frequency of the microwave pulse is v Hertz, then the time interval from the two adjacent microwave pulses is 1/v. It is seen from FIG. 3 that the oval waveguide corresponding to the two adjacent microwave pulses may rotate m times of the ¼ turn where m is an odd number, 1, 3, 5 . . . . If m*(60/n)/4=1/v, it guarantees that the phase shift between two adjacent microwave pulses is 180°, and the relationship between the motor rotation speed and the repetition frequency of the microwave pulse is n=15vm rotations/minute, where m is an odd number, 1, 3, 5 . . . . When one microwave pulse is emitted, the oval waveguide rotates to one of horizontal and vertical states of the long axis; then when the adjacent next microwave pulse is emitted, the oval waveguide rotates to the other of the horizontal and vertical states of the long axis. Because the phase shift of the oval waveguide met by the two adjacent microwave pulses is 180°, the phase shift of two adjacent microwave pulses at the outlet of the phase shifter is 180°.

Suppose m=1, the repetition frequency of the microwave pulse is 1000 Hz, then the time interval for two adjacent microwave pulses is 1 ms. Therefore, the phase shifter needs to phase shift by 180° within 1 ms, and the corresponding motor rotates for ¼ turn. In other words, the motor rotates ¼ turn within 1 ms, such that the time for rotating 1 turn is 4 ms=$4\times10^{-3}$ s. Therefore, the turns rotated in 1 minute is $60/4\times10^{-3}=15000$.

It may be seen from the above that because the phase shifter may achieve a 180° phase shift between two adjacent microwave pluses, this feature may be applied to a plurality of types of accelerators, e.g., (1) The phase shifter of the present disclosure has a unique application in synthesis and distribution of high-power waves, which means synthesizing a plurality of microwaves of different phases or extracting a part of the microwave power. Upon microwave synthesis, the phases of two routes of microwaves might be different; in this way, the synthesized microwave power is not high enough. If a phase shifter is added to one route thereof, the phases of the two routes of microwaves may be made consistent, which is a synthesized application. Besides, the microwave power distribution may use the phase shifter and coupler or magic T (a microwave device) in cooperation, which may implement a microwave distribution of any percentage, wherein the most important is a phase shift of two routes of microwaves, this may be implemented by a phase shifter.

(2) When the electrons are accelerated, phases of microwaves within the acceleration tubes may be adjusted, thereby implementing synchronous acceleration of the electrons.

A phase shifter and an accelerator provided by the present disclosure have been discussed above in detail. The present disclosure employs preferred examples to illustrate the principle and embodiments of the present disclosure. Illustration of the above examples only helps understand the method and its core idea of the present disclosure. It should be understood that for a person of normal skill in the art, several improvements and modifications may be made to the present disclosure. These improvements and modifications also fall within the protection scope of the claims of the present disclosure.

The invention claimed is:

1. A phase shifter, comprising a rotating part having a first hollow structure, the first hollow structure having a first cavity, a distance between a circumference of the cross section of the first cavity and a rotation center of the rotating part changing periodically and continuously in a peripheral direction, such that when the rotatory part rotates, a phase shift occurs between two adjacent microwave pulses at an outlet of the phase shifter.

2. The phase shifter according to claim 1, wherein the distance between the circumference of the cross section of the first cavity and the rotation center of the rotating part changes periodically and continuously in the peripheral direction at 180°.

3. The phase shifter according to claim 2, wherein the phase shift ranges from 0°-180°.

4. The phase shifter according to claim 2, wherein the cross section of the first cavity assumes an oval or rectangular shape.

5. The phase shifter according to claim 1, wherein the cross section of the first cavity assumes an equilateral triangle or an equilateral polygon.

6. The phase shifter according to claim 1, wherein the first hollow structure further comprises two first gradual transition cavities and two first circular waveguides disposed adjacent to two ends of the rotating part respectively, the two first circular waveguides are respectively communicating with two ends of the first cavity through the corresponding first gradual transition cavities.

7. The phase shifter according to claim 6, further comprising two fixing parts respectively disposed adjacent to two ends of the rotating part, the rotating part being rotatable relative to the fixing part; the fixing part comprising a second hollow structure; the second hollow structure having a second cavity; the second cavity comprises a square waveguide, a second gradual transition cavity and a second circular waveguide, the square waveguide communicating with the second circular waveguide through the second gradual transition cavity, the second circular waveguide being adjacent to the rotating part.

8. The phase shifter according to claim 7, wherein the inner diameter of the first circular waveguide is consistent with that of the second circular waveguide.

9. The phase shifter according to claim 8, further comprising a choking structure which is disposed between the first circular waveguide and the second circular waveguide.

10. An accelerator comprising an accelerating tube for accelerating electrons in the accelerator, a phase shifter according to claim 1 and driving means, the phase shifter being disposed in the accelerating tube, the driving means for driving rotation of the rotating part.

11. The accelerator according to claim 10, wherein the accelerating tube comprises a first accelerating tube and a second accelerating tube, the first accelerating tube is disposed upstream of the second accelerating tube, the phase shifter is disposed in the second accelerating tube.

12. The accelerator according to claim 10, wherein a cross section of the first cavity being in an oval shape; and when a microwave pulse is transmitted within the accelerator at a repetitive frequency v Hertz, the driving means drives the rotating part to rotate at a rotation speed of n RPM, wherein n=15vm, m is an odd number, 1, 3, 5 . . . , such that when transmitting a microwave pulse each time, the long axis of the oval cross section of the first cavity of the rotatory part is rotated to a horizontal or vertical state, and the phase shift between two adjacent microwave pluses at an outlet of the phase shifter being 180°.

* * * * *